US010758966B2

(12) United States Patent
MacDougall et al.

(10) Patent No.: US 10,758,966 B2
(45) **Date of Patent: *Sep. 1, 2020**

(54) PROCESSOR-CONTROLLED TAPE FEED APPARATUS AND METHOD FOR A SELF-PIERCING RIVET MACHINE

(71) Applicant: Newfrey LLC, New Britain, CT (US)

(72) Inventors: Jonathan MacDougall, Highland, MI (US); Pradeep Reddy Are, Novi, MI (US)

(73) Assignee: Newfrey LLC, New Britain, CT (US)

( * ) Notice: Subject to any disclaimer, the term of this patent is extended or adjusted under 35 U.S.C. 154(b) by 110 days.

This patent is subject to a terminal disclaimer.

(21) Appl. No.: 15/901,312

(22) Filed: Feb. 21, 2018

(65) Prior Publication Data

US 2019/0255597 A1 Aug. 22, 2019

(51) Int. Cl.

| | |
|---|---|
| ***B21J 15/32*** | (2006.01) |
| ***B21J 15/02*** | (2006.01) |
| ***B21J 15/28*** | (2006.01) |
| ***B65H 37/00*** | (2006.01) |

(52) U.S. Cl.

CPC ..... *B21J 15/323* (2013.01); *B21J 15/025* (2013.01); *B21J 15/28* (2013.01); *B65H 37/002* (2013.01)

(58) Field of Classification Search

CPC ..... B21J 15/025; B21J 15/048; B21J 15/12; B21J 15/26; B21J 15/16; B21J 15/28; B21J 15/323; B21J 15/02; B21J 15/10; B21J 15/32; B25C 1/003; B23P 19/081; B25B 23/045

See application file for complete search history.

(56) References Cited

U.S. PATENT DOCUMENTS

| | | | |
|---|---|---|---|
| 1,967,056 | A | 7/1934 | Horton |
| 3,208,657 | A | 9/1965 | Cohn |
| 3,456,445 | A | 7/1969 | Bentele et al. |

(Continued)

FOREIGN PATENT DOCUMENTS

| | | | |
|---|---|---|---|
| EP | 0593970 | A1 | 4/1994 |
| EP | 2498934 | A1 | 9/2012 |

(Continued)

OTHER PUBLICATIONS

International Search Report and Written Opinion dated May 24, 2019 in corresponding International Application No. PCT/US2019/018917.

*Primary Examiner* — Christopher J Besler

(74) *Attorney, Agent, or Firm* — Harness, Dickey & Pierce, P.L.C.

(57) ABSTRACT

Self-piercing rivets deployed in an elongated tape are moved into alignment with a rivet driving spindle using a processor-controlled servomotors. The tape is conveyed between a supply reel and an exhaust reel, the supply reel having a supply motor and the exhaust reel having an exhaust motor. The tape is moved under processor control in an advancing direction until the rivet has traveled past being in alignment with the spindle, by controlling the supply and exhaust motors using a first tension regimen. Thereafter the tape is moved under processor control in a retracting direction until the rivet is in alignment with the spindle by controlling the tape supply and exhaust motors using a second tension regimen.

16 Claims, 8 Drawing Sheets

(56) References Cited

U.S. PATENT DOCUMENTS

| | | | |
|---|---|---|---|
| 3,543,987 | A | 12/1970 | Obergfell et al. |
| 3,920,130 | A | 11/1975 | Edgett |
| 4,015,799 | A | 4/1977 | Koski et al. |
| 4,089,009 | A | 5/1978 | Frazier |
| 4,119,258 | A | 10/1978 | Ewig, Jr. |
| 4,133,102 | A | 1/1979 | Gillemot |
| 4,319,705 | A | 3/1982 | Geist et al. |
| RE30,939 | E | 5/1982 | d'Alayer de Costemore d'Arc et al. |
| 4,404,742 | A | 9/1983 | Fuhrmeister |
| 4,410,103 | A | 10/1983 | Fuhrmeister |
| 4,615,475 | A | 10/1986 | Fuhrmeister |
| 4,716,124 | A | 12/1987 | Yerman et al. |
| 4,788,558 | A | 11/1988 | Caldwell et al. |
| 4,942,996 | A | 7/1990 | Wolfberg et al. |
| 5,032,211 | A | 7/1991 | Shinno et al. |
| 5,184,497 | A | 2/1993 | Hanlon et al. |
| 5,191,693 | A | 3/1993 | Umetsu |
| 5,267,401 | A | 12/1993 | Freeman et al. |
| 5,339,983 | A | 8/1994 | Caple |
| 5,388,721 | A | 2/1995 | Mauer |
| 5,454,900 | A | 10/1995 | Han et al. |
| 5,542,323 | A | 8/1996 | Habermehl et al. |
| 5,755,519 | A | 5/1998 | Klinefelter |
| 5,779,127 | A | 7/1998 | Blacket et al. |
| 5,813,114 | A | 9/1998 | Blacket et al. |
| 6,089,437 | A | 7/2000 | Blacket et al. |
| 6,116,835 | A | 9/2000 | Blacket et al. |
| 6,164,489 | A | 12/2000 | Altrock |
| 6,266,871 | B1 | 7/2001 | Edwards |
| 6,502,783 | B1 | 1/2003 | Smith et al. |
| 6,536,660 | B2 | 3/2003 | Blankenship et al. |
| 6,592,015 | B1 | 7/2003 | Gostylla et al. |
| 6,828,743 | B2 | 12/2004 | Debuf |
| 6,942,134 | B2 | 9/2005 | Naito |
| 6,963,351 | B2 | 11/2005 | Squires et al. |
| 7,131,564 | B2 | 11/2006 | Matthews et al. |
| 7,212,637 | B2 | 5/2007 | Salisbury |
| 7,726,598 | B2 | 6/2010 | Morelli et al. |
| 7,896,212 | B2 | 3/2011 | Uejima et al. |
| 8,915,460 | B2 | 12/2014 | Busch et al. |
| 8,950,049 | B2 | 2/2015 | Williams |
| 9,120,141 | B2 * | 9/2015 | Clew ..... B21J 15/323 |
| 9,457,921 | B2 | 10/2016 | Barnes et al. |
| 10,456,826 | B2 * | 10/2019 | Kho ..... B21J 15/323 |
| 2004/0136768 | A1 | 7/2004 | Klinefelter et al. |
| 2006/0266869 | A1 | 11/2006 | Quittkat |
| 2008/0230646 | A1 | 9/2008 | Morelli et al. |
| 2008/0251559 | A1 | 10/2008 | Uejima et al. |
| 2013/0223956 | A1 | 8/2013 | Gostylla |
| 2014/0000419 | A1 | 1/2014 | Park |
| 2014/0217227 | A1 | 8/2014 | Kilibarda et al. |
| 2014/0260831 | A1 | 9/2014 | Hays et al. |
| 2015/0101175 | A1 | 4/2015 | Xi et al. |

FOREIGN PATENT DOCUMENTS

| | | | |
|---|---|---|---|
| EP | 2953772 | A1 | 12/2015 |
| WO | WO-93/01014 | A1 | 1/1993 |
| WO | WO-96/28266 | A1 | 9/1996 |
| WO | WO 2011/058297 | A1 | 5/2011 |
| WO | WO-2012/046002 | A2 | 4/2012 |
| WO | WO-2014/124007 | A1 | 8/2014 |

* cited by examiner

PROCESSOR-CONTROLLED TAPE FEED APPARATUS AND METHOD FOR A SELF-PIERCING RIVET MACHINE

FIELD

The present disclosure relates to a tape feed apparatus and method for a self-piercing rivet machine.

BACKGROUND

This section provides background information related to the present disclosure which is not necessarily prior art.

Existing tape feed systems for self-piercing rivet machines typically have a ratcheting wheel between the self-piercing rivet fastener supply reel and the receiver. The exhausted tape leaving the receiver is typically left as a free end and allowed to fall on the floor. Cleaning up this exhausted tape can cost a surprisingly large amount of money for a manufacturer to clean up; hundreds of thousands of dollars, if not millions of dollars annually.

SUMMARY

This section provides a general summary of the disclosure, and is not a comprehensive disclosure of its full scope or all of its features.

According to one aspect of the present disclosure, a tape carried, self-pierce rivet may be moved into alignment with a rivet driving spindle by conveying the tape between a supply reel and an exhaust reel, the supply reel having a supply motor and the exhaust reel having an exhaust motor. Specifically, the tape is moved in an advancing direction until the rivet has traveled past being in alignment with the spindle, by controlling the supply and exhaust motors using a first tension regimen. Thereafter the tape is moved in a retracting direction until the rivet is in alignment with the spindle by controlling the tape supply and exhaust motors using a second tension regimen.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 3B:
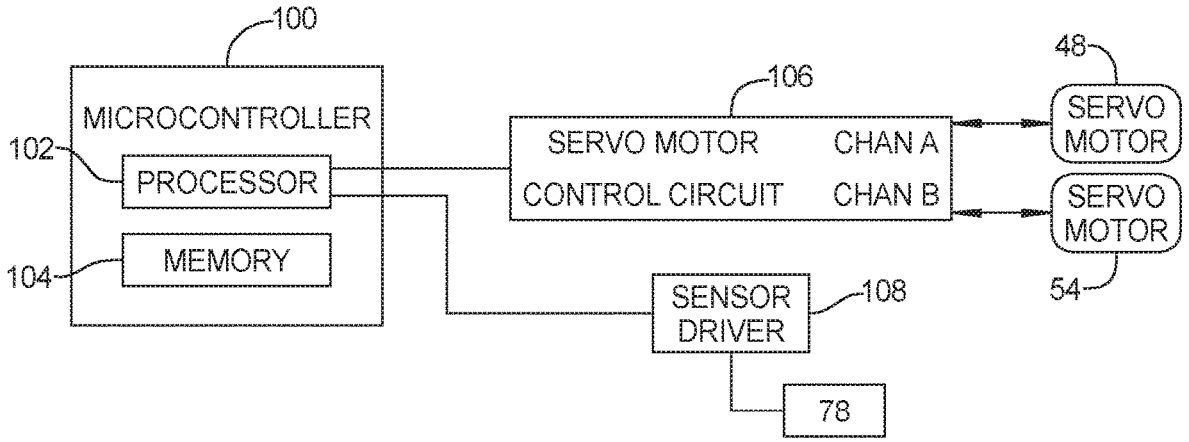
Figure 3A:
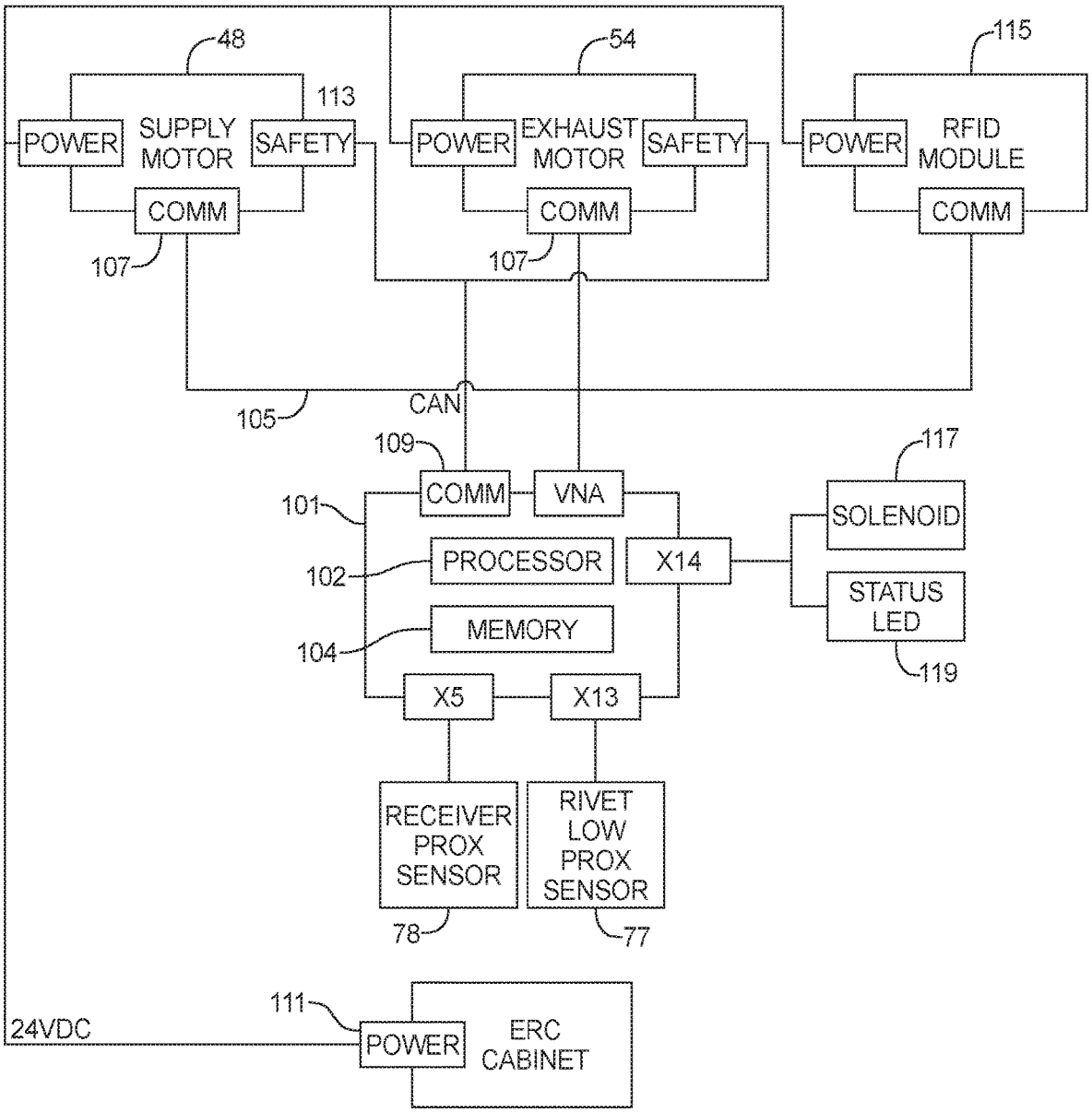

FIG. 3*a* is an electronic circuit diagram of a first embodiment of the processor-controlled tape feed system.

FIG. 3*b* is an electronic circuit diagram of a second embodiment of the processor-controlled tape feed system.

Figure 4:
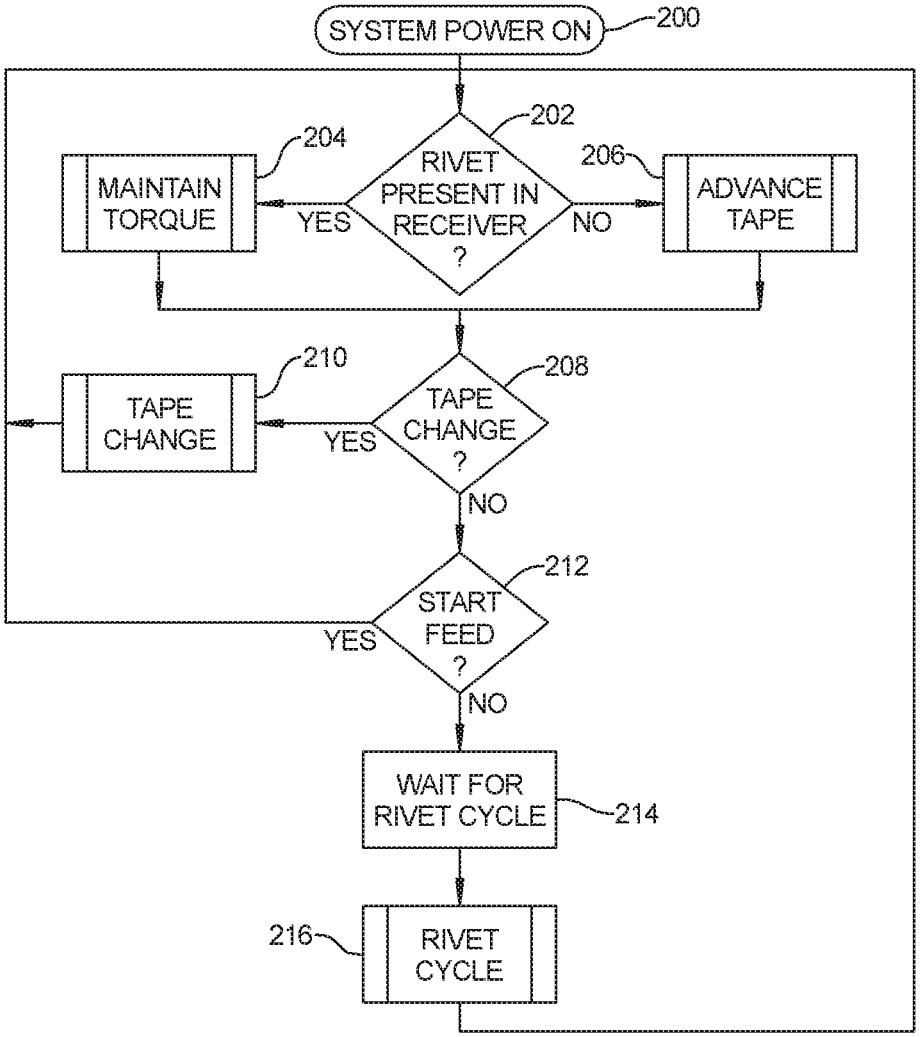

FIG. 4 is a flowchart illustrating the overall riveting process using the processor-controlled tape feed system.

Figure 5:
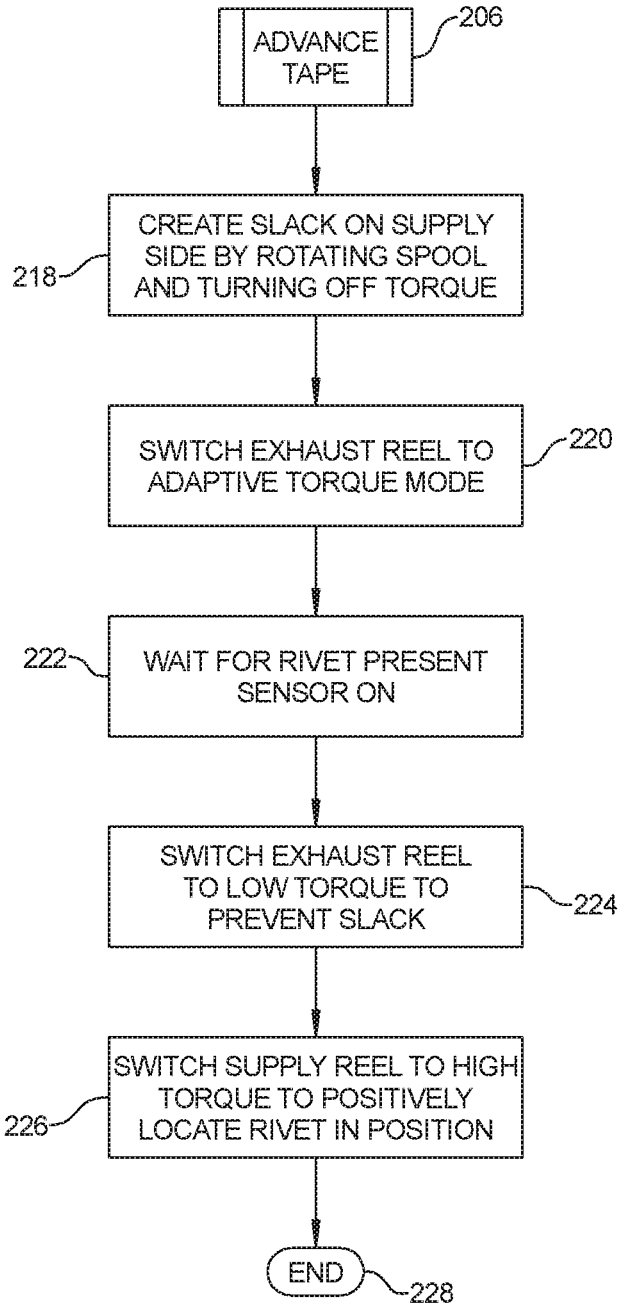

FIG. 5 is a flowchart detailing the 'advance tape' subprocess defined in FIG. 4.

Figure 6:
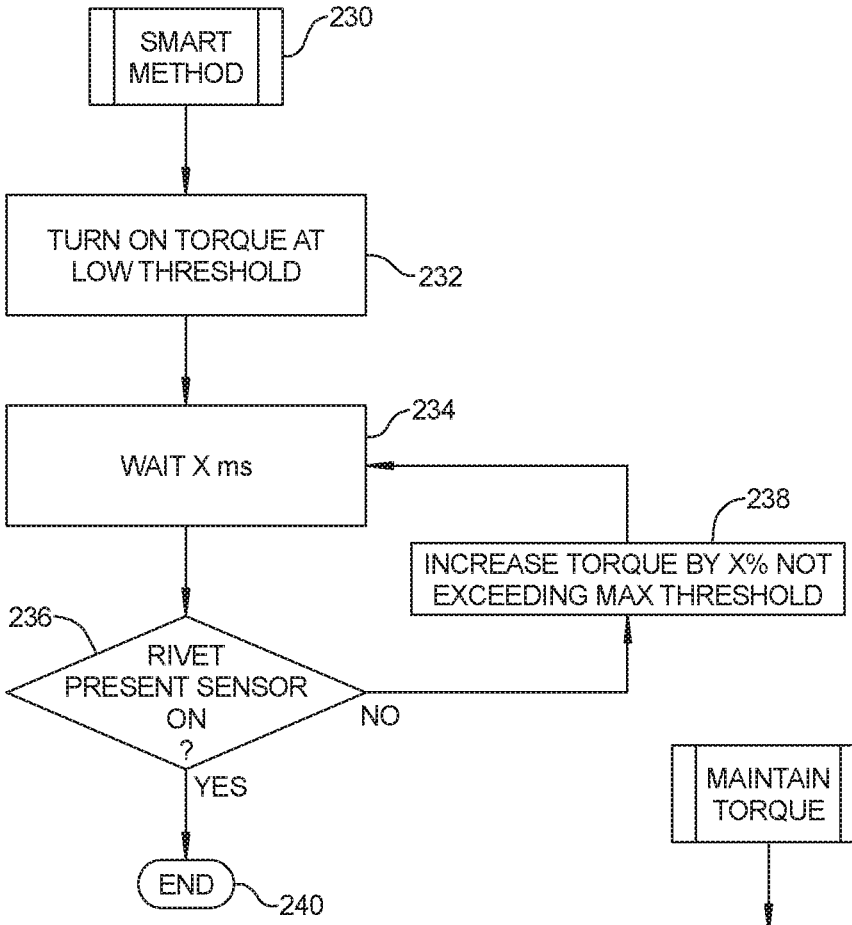

FIG. 6 is a flowchart detailing a first embodiment for adaptive reel tensioning.

Figure 7:
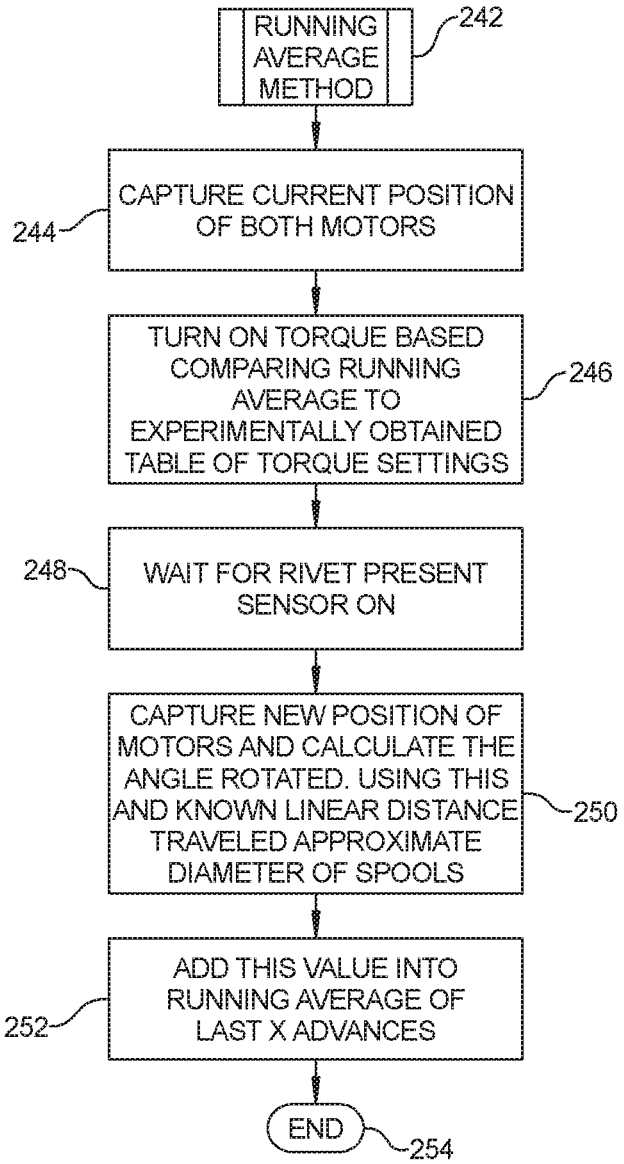

FIG. 7 is a flowchart detailing a second embodiment for adaptive reel tensioning.

Figure 8:
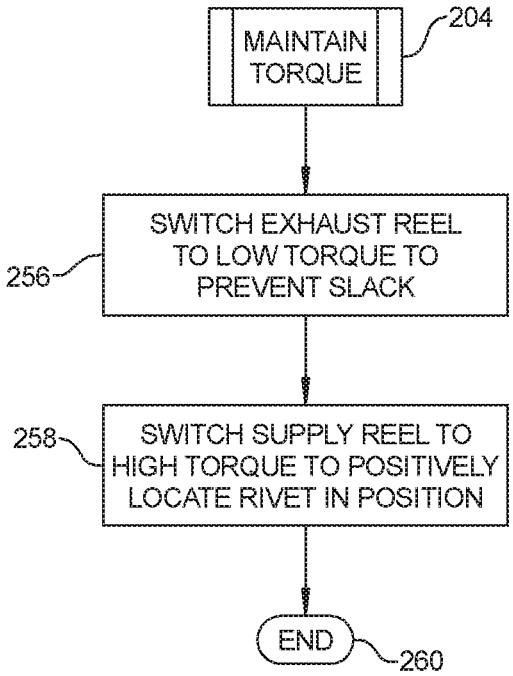

FIG. 8 is a flowchart detailing the 'maintain torque' subprocess defined in FIG. 4.

Figure 9:
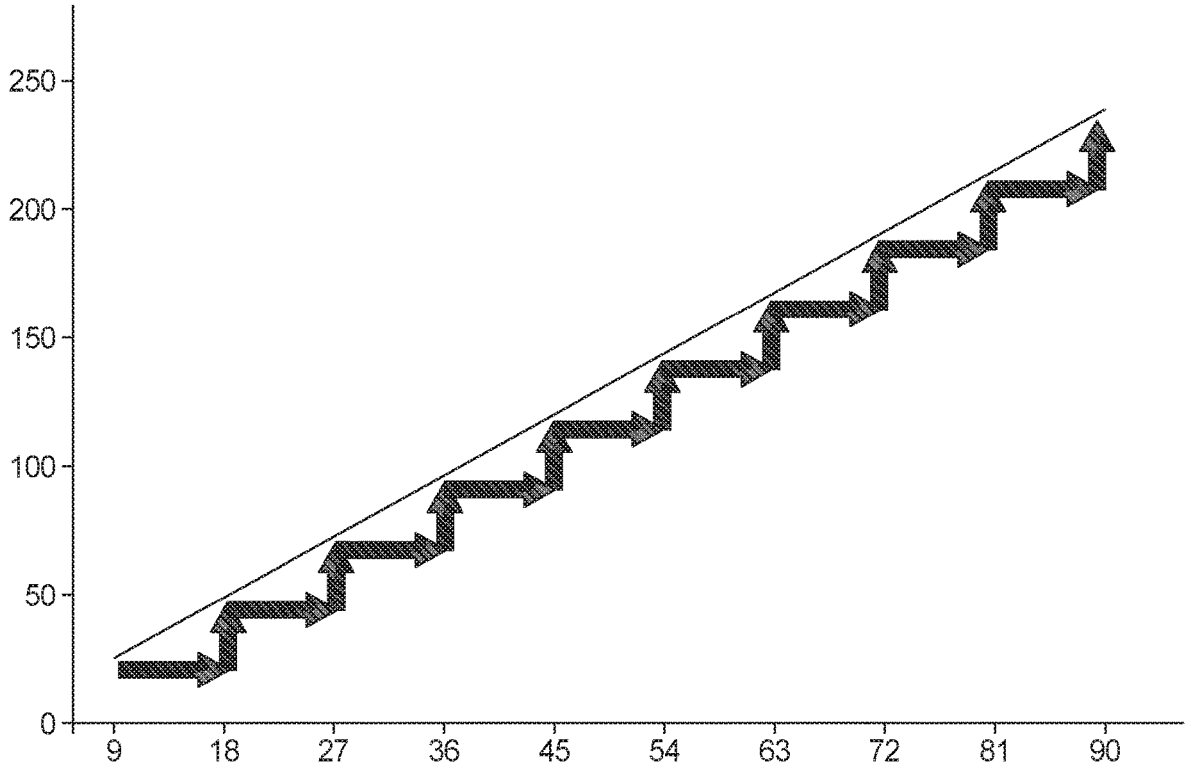

FIG. 9 is a graph showing how the torque of the servomotor is ramped up to implement the subprocess illustrated in FIG. 5.

Corresponding reference numerals indicate corresponding parts throughout the several views of the drawings.

DETAILED DESCRIPTION

Example embodiments will now be described more fully with reference to the accompanying drawings.

Figure 1:
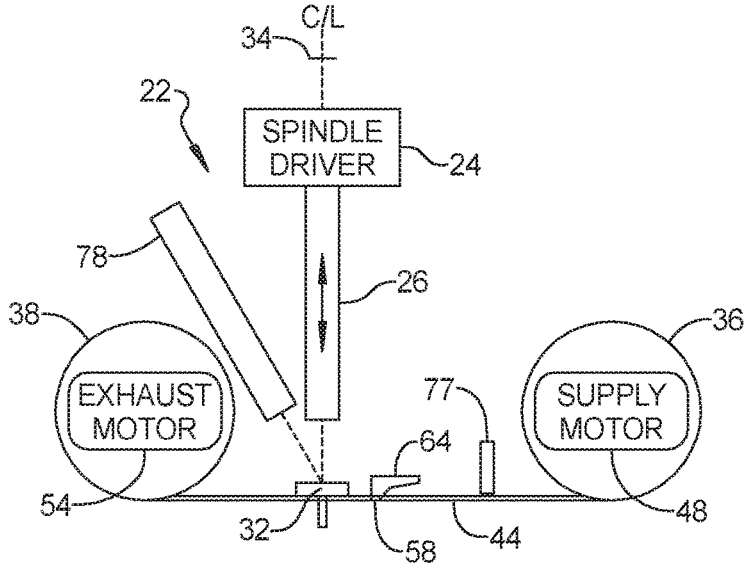
FIG. 1 is a diagrammatic view of a self-piercing rivet machine employing the disclosed processor-controlled tape feed system.

Referring to FIG. 1, an exemplary embodiment of the self-piercing rivet machine in accordance with the present disclosure is illustrated generally at 22. The machine includes a spindle 24 with associated driver mechanism, which operates to drive the rivet punch 26 in a reciprocating direction along the centerline axis 34 of the rivet punch. Rivets are delivered and positioned in the receiver with extreme accuracy beneath the rivet punch 26 by means of a tape assembly which will be next described. For additional details of mechanical systems that may be used to implement the self-piercing rivet machine, reference may be had to co-pending U.S. patent applications, entitled "Tape Feed Apparatus And Method For A Self-Piercing Rivet Machine", Ser. No. 15/901,236 (filed Feb. 21, 2018), and "Tool-Free Opening Tape Feed Receiver For A Self-Piercing Rivet Machine", Ser. No. 15/901,264 (filed Feb. 21, 2018), the entire specifications and drawings of each are incorporated herein by reference.

Figure 2:
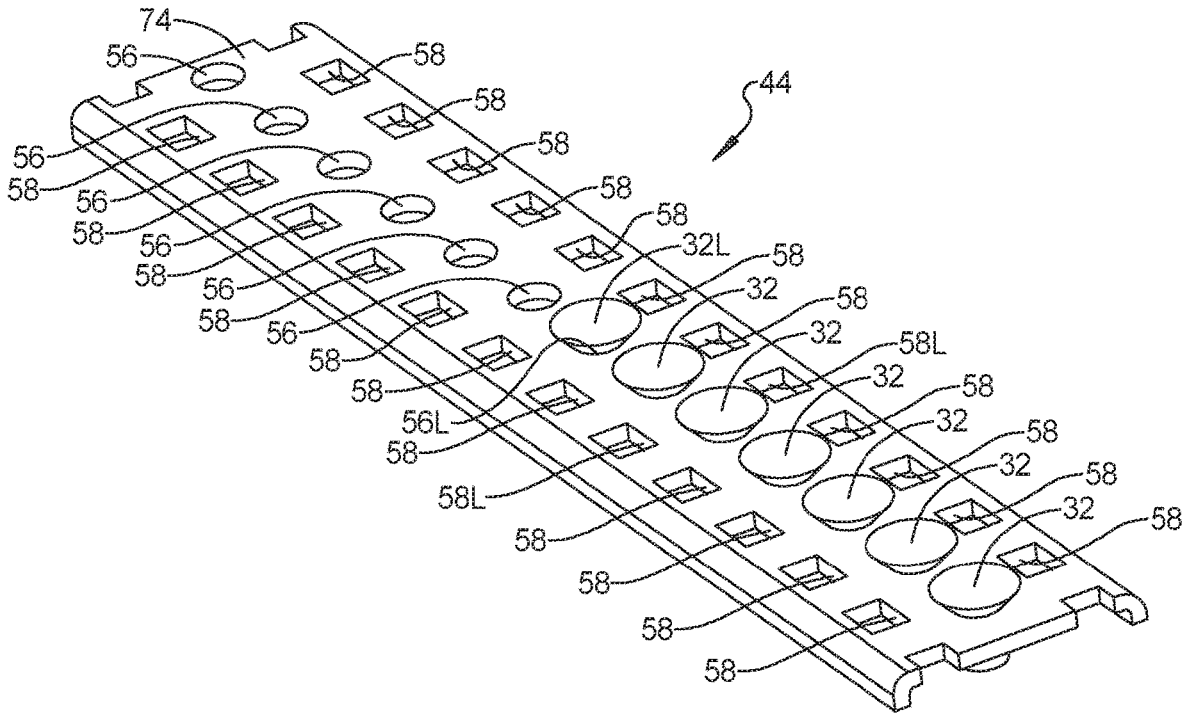
FIG. 2 is a perspective view of a self-piercing rivet carrier tape, illustrating the relation between rivets and rivet positioning apertures.

Rivets to be applied are first installed on an elongated tape, in a spaced apart configuration as illustrated in FIG. 2. The tape has a series of regularly spaced apertures 58 that are designed to register with a pawl mechanism 64 (FIG. 1). The engagement of pawl mechanism with a selected aperture positions the associated rivet precisely in alignment with the centerline 34 of punch 26 during operation of the machine as will be described.

The elongated tape 44 is supplied, wound up on a supply reel 36. The supply reel is installed on the spindle of a supply motor 48, which is preferably implemented using a servomotor. The rivet machine also includes an exhaust reel 38 to receive the spent tape, thus solving the problem of having the spent tape exhaust onto the floor. The exhaust reel is carried on the spindle of an exhaust motor, also preferably implemented using a servomotor. To sense when the end of the portion of the tape containing rivets has been reached, an inductive sensor 77 is provided downstream of the supply reel but upstream of the punching zone. To sense when a rivet is positioned approximately within the punching zone, a rivet-present sensor 78 is employed. In the illustrated embodiment this sensor is an inductive sensor available from Turck, Inc. Note the sensor 78 is positioned so that it will not interfere with reciprocating movement of the rivet punch.

The sensor 78 is designed to sense the presence of metal rivets with precision. As manufacturing with lighter materials is in demand today, the present inductive sensor is designed to sense rivets that are not necessarily made of ferrous metals, such as rivets made of aluminum. The inductive sensor has an internal inductive coil that is energized by an oscillator which produces an electromagnetic detection field emanating from the tip of the sensor. The presence of a metal object (such as the head of rivet 32) in the detection field alters the permeability of the space occupied by the detection field. This change in permeability results in a change in resonance of the oscillating energy, which is then sensed by the internal electronic circuitry associated with the oscillator. Although ferrous metals produce the strongest coupling with the detection field, other metals such as aluminum also produce changes in the detection field, which can be measured by the sensor.

Sensor 78 thus operates as a non-contact electromagnetic sensor. While the inductive sensor is well adapted to sensing non-ferrous rivets, such as aluminum rivets, other types of sensing technology can also be employed. Optical sensors, another form of electromagnetic sensing, for example, can be used where the rivet material is not suitable for inductive sensing.

In the disclosed embodiment, the sensor 78 is positioned at an angle, as illustrated, so that it can sense when the head of rivet 32 has traveled past the position where it is aligned with the centerline 34. The disclosed processor-controlled tape feed apparatus and method specifically relies on having the rivet advance slightly past the point of perfect centerline alignment during the tape advancement tension regimen, so that the rivet can be retracted into perfect centerline alignment during the subsequent retracting tension regimen. It is the subsequent retracting tension regimen that allows the pawl mechanism 64 to engage with the corresponding aperture 58 in the tape 44. In this way, high accuracy is achieved in placement of the rivet directly in registration with the punch centerline without requiring the machine itself to be manufactured to high tolerances. This is because accuracy is achieved by virtue of the high tolerance of the tape.

FIG. 3*a* illustrates a first embodiment of an electronic circuit which may be used to implement the processor-controlled tape feed apparatus and method. In this embodiment a digital command controller (DCC) 101 is employed. The digital command controller includes an internal CPU processor 102 and associated memory 104, together with other digital signal processing components used to control other processes associated with setting the self-piercing rivets. The digital command controller may be implemented, for example, using a Texas Instruments TMS320F microcontroller. The digital command controller 101 communicates over a controller area network bus (CAN bus), depicted in FIG. 3*a* at 105. In FIG. 3*a*, selected interface control pins have been illustrated at X5, X13 and X14. Those of skill in the art will understand that the specific pins used for connection to sensors, solenoids and status indicators are a matter of design choice. Thus the pins illustrated here are merely exemplary.

In this embodiment one primary function of the digital command controller 101 is to send commands to the spindle driver 24 (FIG. 1) causing it to drive the rivet punch 26 to impact and set the rivet. In addition, the internal CPU processor 102 of the digital command controller 101 also controls the tape feed apparatus to implement the methods described herein.

In this embodiment each of the supply servomotor 48 and the exhaust servomotor 54 may be implemented using a self-contained controller-motor package that includes a communication port 107 designed to interface with the CAN bus 105. A suitable motor package is the model PD4-C6018L4204-E-08 available from Nanotec Electronic US Inc. The digital command controller 101 also has a communication port 109 to interface with the CAN bus 105. Essentially each self-contained controller-motor package receives control data signals, addressed for it, on the CAN bus 105. The motor responds by rotating to the position specified by control data placed on the CAN bus 105. By virtue of the CAN bus interconnection, each of the respective servomotors can be controlled independently of one another through instructions from the digital command controller that are addressed for the particular servomotor.

As illustrated in FIG. 3*a*, each motor 48 and 54 is supplied with 24 volt DC operating power from a cabinet-mounted power supply 111. Each motor also includes a safety circuit 113 that interfaces with the digital command controller 101 to disengage or enter an off state when conditions warrant as determined by the digital command controller 101.

The circuit of FIG. 3*a* also includes an RFID module 115, implemented as an electronic circuit powered by power supply 111 that senses a corresponding RFID tag (not shown) placed on the supply reel 36. The RFID tag system is used to ensure that the proper size and style of rivet has been loaded into the rivet machine. As illustrated, the RFID module 115 communicates this information to the digital command controller 101 over the CAN bus 105.

In one embodiment, the supply and exhaust reels are secured by solenoid(s) 117 controlled by the digital command controller 101. Status LED indicators 119 are provided to visually indicate the tape loading state. Solenoids 117 and status LEDs 119 are controlled by connection to the digital command controller 101.

FIG. 3*b* illustrates a second embodiment of an electronic circuit which may be used to implement the processor-controlled tape feed apparatus and method. A microcontroller 100 comprising processor 102 and associated memory 104 issues drive instructions to the respective supply motor 48 and exhaust motor 54. Suitable servomotor control circuitry 106 is provided as illustrated. Note that each of the respective servomotors is controlled independently. Thus the servomotor control circuit 106 has a first channel A for communication with servomotor 48 and a second channel B for communication with servomotor 54.

Each servomotor includes a motor to produce torque in varying amounts based on received control signals from the processor 102. In addition, each servomotor includes a position sensor to provide a feedback signal through the servomotor control circuit to the processor 102. Knowing the position of the servomotor allows the processor to precisely control the servomotor's operation. This includes controlling the torque supplied by the motor, which some of the disclosed control regimens are able to exploit.

The processor 102 is also coupled to the sensor driver 108 which interfaces with the inductive sensor 78. The processor reads the signals produced by sensor 78 to determine if a rivet is positioned at the point slightly beyond centerline registration, indicating that the processor can command a change from the advancing tape tension regimen to the retracting tape tension regimen. A discussion of the advancing and retracting tape tension regimens will not be provided.

Overall System Process

The advancement of the tape is a processor-controlled process, the processor being specifically programmed as described herein. FIG. 4 shows the overall system process. The overall system process begins when the system is powered on at 200. Using the rivet-present sensor 78 (FIG. 1) to supply a binary (ON-OFF) rivet-present signal, the processor 102 (FIG. 1) determines at step 202 whether to maintain torque, as at 204 (the details of which are described in connection with FIG. 8), or to advance the tape, as at 206 (the details of how the tape is advanced will be described below in connection with FIG. 5). In other words, after every rivet cycle the system will determine if it needs to advance the tape to the next position, as at step 206, or to hold the current position by maintaining position as at step 204. The processor 102 makes this determination by looking at both the state of the rivet-present sensor 78 (indicating whether there is a rivet in the receiver) and based on stored knowledge of whether the rivet has left the receiver during the previous rivet cycle.

Regarding this stored knowledge, the processor maintains a record in memory 104 as to whether the last rivet cycle resulted in a rivet being set in the workpiece. This record is maintained because certain faults can happen before the rivet is inserted into the work piece thereby leaving the rivet inside the nose piece. In this scenario the processor is programmed not to advance the tape because if the process is retried two rivets will be deployed in the receiver. If the processor determines that it doesn't need to advance it will simply maintain the positive location of the tape in its current position.

In performing the overall system process the processor 102 is also programmed to assess at step 208 whether a tape change is necessary. This happens when the last rivet in the tape has been used and the end of the tape is sensed by suitable mechanism. In the illustrated embodiment of FIG. 1, the sensor 77 detects when the end of tape is reached, that being the point at which no further rivets are sensed exiting the supply reel as the tape advances towards the spindle.

Instead of using a rivet sensor 77, the end-of-tape condition may be sensed by detecting that there is no load on the supply servomotor 48, or by using a suitable microswitch sensor, magnetic sensor or optical sensor to detect an end-of-tape marker or detent formed in the tape itself. Regardless of what sensing mechanism is used, when the end-of-tape condition is sensed, the processor 102 sends control commands, at step 210 to the servomotors 48 and 54 to disengage or enter an off state, to allow the tool operator to place a fresh reel of tape on the spindle of the supply motor 48 and to thread the fresh tape onto a newly installed exhaust reel. To alert the operator when it is time to replace the tape, the processor 102 may also issue an alert (e.g., audible or visual) locally at the machine, using the status LED's 119 (FIG. 3*a*) for example, or remotely at a control console within the plant.

Assuming no tape change is required (either because the current tape still has unspent rivets, or because a fresh reel has just been loaded) the processor 102 makes the fundamental decision at 212 whether a tape feed operation should be performed. As the flowchart of FIG. 4 shows, when processor reaches step 212 there should be a rivet present in the receiver (as determined at step 202), unless a fault has occurred as discussed above. Thus at step 212, if there is no rivet detected by the rivet presence sensor 78, the processor reverts back to repeat step 202 and the ensuing steps. However, if there is a rivet present (as would normally be the case), the processor enters a waiting cycle at step 214 until the rivet cycle 216 is complete. Depending on the tool implementation, in one embodiment (using the circuit of FIG. 3*a*, for example), the processor 102 within the digital command controller 101 may be programmed to issue the trigger instruction to the spindle driver mechanism, in which case the processor 102 has self-generated information indicating when the rivet cycle is complete.

In alternate embodiments (using the circuit of FIG. 3*b*, for example) the spindle driver 24 (FIG. 1) is controlled by a separate trigger mechanism, independent of processor 102. In this embodiment the processor 102 includes an input that receives a signal from the spindle driver mechanism (or from the processor within the digital command controller 101, indicating that the rivet cycle is complete.

Advance Tape Process

The advance tape process 206 is shown in detail in FIG. 5. In one embodiment, as depicted in FIG. 5, the processor 102 commands to supply servomotor 48 to create slack in the supply side reel to ease advancement of the tape, either by rotating the supply servomotor (clockwise as seen in FIG. 1) or by turning off the motor torque. More specifically, this can be achieved by clocking the supply motor a set distance to create the slack after the rivet cycle 216 (FIG. 4).

Alternatively this can be achieved by turning off the holding torque of the supply motor while the spindle 26 (FIG. 1) is still fully advanced. The natural motion of the spindle returning to home position will then introduce slack in the system.

As yet another alternative, a higher torque may be used on the exhaust motor 54 to advance the tape without the need for slack to be created.

In order for the system to advance the tape, the processor 102 then switches the motors into an adaptive torque mode, one embodiment of which is illustrated in FIG. 6 discussed below. The adaptive torque mode is designed to adjust the tension of the tape as it enters the receiver, to consistently align the rivet under the punch as the tape transitions from full to empty on the supply side and vice versa on the exhaust side. The adaptive torque mode can be accomplished in a variety of ways; three methods will be described below.

Continuing with a discussion of the advance tape process, after the processor switches to adaptive torque mode, it waits at step 222 until a rivet is detected by the rivet-present sensor 78. Specifically, the processor waits until the rivet-present signal is in the ON state. Upon detection of the ON state, the processor, at step 224, sends an instruction to the exhaust servomotor, causing it to switch to a low torque state to prevent slack. Thereafter, in step 226, the processor sends a signal to the supply servomotor, causing it to switch to a high torque state, which will pull back on the tape allowing the pawl mechanism 64 to engage with the corresponding aperture 58 in the tape 44 (FIG. 1). Such engagement positively locates the rivet in proper position along the axis 34 of the spindle. The advance tape process then ends at 228.

Next follows a summary of three potential methods that can be employed to drive the system into adaptive torque mode. All of these methods adjust the tension of the tape as it enters the receiver, to consistently align the rivet under the punch as the tape transitions from full to empty on the supply side and vice versa on the exhaust side. These techniques for implementing an adaptive torque mode are referred to herein as:

1. Simplified Method for Adaptive Reel Tensioning (SMART)
2. Rivet Count Method
3. Running Average Method Simplified Method for Adaptive Reel Tensioning (SMART):

Shown in FIG. 6, the simplified method 230 for adaptive reel tensioning takes advantage of closed loop servo mechanism of the servomotors 48 and 54 to command the supply and exhaust reel motors to maintain a specific torque set-point and uses the status of rivet presence sensor 78 to ramp up the torque set-point on the exhaust side motor until a rivet is sensed by the rivet presence sensor. Simultaneously, the status of the rivet presence sensor is also used to adjust the torque set-point on the supply servomotor 48 to aid the exhaust servomotor 54 to pull the tape far enough into the receiver until the rivet is positively sensed by the rivet presence sensor. Sensor-based adjustment of torque ramp up eliminates the need to calculate or derive the amount of tape present (rolled-up on the supply and exhaust side spools respectively) to maintain optimal tension on the tape as it enters the receiver that helps to consistently place the rivet under the punch. An example of how the processor controls torque ramp-up is illustrated in FIG. 9.

In the simplified method 230 the processor 102 turns on torque to a low threshold 232 and then waits a predetermined time 234 (typically on the order of a few milliseconds). After the brief wait, the processor then reads the state of the rivet-present signal (from rivet-present sensor 78) at step 236. If the rivet-present signal is not in the ON state (i.e., it is in the OFF state) the processor 102 signals the motors to increase torque by a predetermined fixed percentage, but without exceeding a predetermined maximum threshold, as at step 238. Conversely, if the rivet-present signal is in the ON state, the simplified method for adaptive reel tensioning ends at 240.

Running Average Method:

Shown, in FIG. 7, the running average method takes advantage of the closed loop servo mechanism of the servomotors 48 and 54 to derive the position of the supply and exhaust servomotors driving the rivet spools after each rivet cycle. The position data from both supply and exhaust servomotors is then compared against a pre-calculated dataset that maintains running average of the position data from both the motors to accurately estimate the amount of tape left (i.e., rolled-up in the supply and exhaust side motors respectively).

As illustrated, the running average method 242 first captures the current position of both motors at 244. In this regard, one feature of the servomotors is that they provide a data signal indicative of angular position of the motor shaft. Next, at step 246, the processor turns on torque to the motors, based on a comparison of a position data running average maintained by the processor 102 in memory 104 to a table of predetermined torque settings also stored in memory 104. These predetermined torque settings may be determined experimentally and stored in a table prior to use of the system.

The processor then waits at step 248 until the rivet-present signal is in the ON state, whereupon the processor captures new positions for both motors and calculates the angle rotated. Using this angle rotated and the known linear distance traveled for such rotation, the processor, at step 250, calculates the approximate diameter of the tape extant on each of the supply and exhaust reels. The processor, at step 252, then adds this calculated value to the running average of the last X advances (where X is an integer number reflecting how many times the motor position data have been captured for use in the described calculations. The running average method then terminates at step 254.

Rivet Count Method:

This method uses data from a processor (possibly separate from processor 102) that is currently running a self-piercing riveting system, such as the Stanley Portariv® Pierce Riveting System, to count the number of rivet cycles since a reel load/change operation has occurred. The processor 102 uses this data to adapt the tension of the supply and exhaust servomotors 48 and 54 to consistently place the rivet under the punch in a tape feed riveting application.

Using one of the three adaptive tension mode methods described above, or equivalent, the tape will continue to be pulled through the receiver until the rivet presence sensor 78 detects that the rivet has completed the required advancement.

The following section provides a summary of "Maintain Torque" subprocess shown in Flowchart 1 which helps to positively lock the rivet in position under the punch until the riveting sequence begins.

Maintain Torque Process

As was discussed in connection with FIG. 4, processor 102 performs the maintain torque step 204 if a rivet is present in the receiver as determined at step 202. This maintain torque process helps positively lock the rivet in precise position under the punch until the riveting sequence begins. The particulars of this maintain torque step 204 will now be described with reference to FIG. 8.

After the rivet presence sensor detects the presence of rivet in the receiver, the processor commands the exhaust servomotor 54 to switch to a constant low torque, as at 256. This low torque is set to a level that will not overpower the supply servomotor, but to a level sufficient to ensure that all slack is taken up on that side of the receiver and to ensure that the reel won't free spin. The processor further commands the supply servomotor 48, at step 258, to switch to a constant high torque in order to positively align the tape into the locking pawls. The process then ends at 260. Note that although steps 256 and 258 have been illustrated as being sequential, it is possible to execute steps 256 and 258 substantially simultaneously.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method for moving a tape carried, self-piercing rivet into alignment with a rivet driving spindle, comprising:

conveying the tape between a supply reel and an exhaust reel, the supply reel having a supply motor and the exhaust reel having an exhaust motor;

moving the tape in an advancing direction until the rivet has traveled past being in alignment with the spindle, by controlling the supply and exhaust motors using a first tension regimen; and thereafter moving the tape in a retracting direction until the rivet is in alignment with the spindle by controlling the tape supply and exhaust motors using a second tension regimen.

2. The method of claim 1 further comprising:

sensing that the rivet has traveled past being in alignment with the spindle.

3. The method of claim 1 further comprising:

sensing that the rivet occupies a position of having traveled past being in alignment with the spindle.

4. The method of claim 3 wherein the sensing is performed using a non-contact sensor responsive to presence of the rivet within a predetermined field.

5. The method of claim 4 wherein the non-contact sensor is an inductive sensor.

6. The method of claim 4 wherein the non-contact sensor is an optical sensor.

7. The method of claim 1 wherein the first tension regimen comprises incrementally increasing an exhaust torque on the exhaust motor until the rivet has traveled past being in alignment with the spindle.

8. The method of claim 1 wherein the second tension regimen comprises increasing a supply torque on the supply motor while establishing an exhaust torque on the exhaust motor sufficient to mitigate slack in the tape as the rivet is in alignment with the spindle.

9. The method of claim 1 wherein the first tension regimen comprises applying adaptive torque on the exhaust motor, where the adaptive torque is computationally established to account for the changing diameters of tape on the supply and exhaust reels as the tape transitions from a full to empty on the supply reel and empty to full on the exhaust reel.

10. The method of claim 9 wherein the adaptive torque is computationally established by maintaining a running counting of rivets as they are set by the spindle.

11. The method of claim 9 wherein the adaptive torque is computationally established by capturing a first position of both motors at the beginning of a rivet cycle, capturing a second position of both motors at the end of the rivet cycle, using the first and second positions and the linear distance along the tape between individual rivets to calculate the diameter of the tape extant on at least one of the reels, using the calculated diameter to update a running average of a tape advance distance.

12. The method of claim 1 further comprising establishing that the rivet is in accurate alignment with the spindle using a locking pawl positioned to engage an aperture in the tape as the tape is moving in a retracting direction during the second tension regimen.

13. The method of claim 1 wherein the first tension regimen comprises reducing torque on the supply motor to create slack in the tape.

14. The method of claim 7 wherein the first tension regimen comprises reducing torque on the supply motor to create slack in the tape.

15. The method of claim 8 wherein the first tension regimen comprises reducing torque on the supply motor to create slack in the tape.

16. The method of claim 1 wherein the first tension regimen comprises applying a higher torque on the exhaust motor than a torque being applied on the supply motor to advance the tape without the need for slack to be created.

* * * * *